US007683779B1

(12) United States Patent
Pacheco

(10) Patent No.: US 7,683,779 B1
(45) Date of Patent: Mar. 23, 2010

(54) FLATWARE DETECTION APPARATUS

(76) Inventor: Juan M. Pacheco, 12580 Piping Rock Dr., Houston, TX (US) 77077

( * ) Notice: Subject to any disclaimer, the term of this patent is extended or adjusted under 35 U.S.C. 154(b) by 265 days.

(21) Appl. No.: 11/776,496

(22) Filed: Jul. 11, 2007

Related U.S. Application Data

(60) Provisional application No. 60/807,384, filed on Jul. 14, 2006.

(51) Int. Cl.
*G08B 13/14* (2006.01)

(52) U.S. Cl. ..... 340/568.1; 340/551; 340/500; 209/215

(58) Field of Classification Search ..... 340/568.1, 340/551, 500; 209/215, 226, 235, 259, 260
See application file for complete search history.

(56) References Cited

U.S. PATENT DOCUMENTS 4,632,253 A * 12/1986 Stromgren et al. ..... 209/570
4,742,339 A 5/1988 Baziuk
5,538,143 A * 7/1996 Pettersson ..... 209/698
5,797,497 A * 8/1998 Edwards ..... 209/570
6,222,450 B1 4/2001 Clements
6,667,689 B1 * 12/2003 Steffen et al. ..... 340/568.1
6,833,789 B1 * 12/2004 Carmen et al. ..... 340/551
2004/0000904 A1 * 1/2004 Cotter ..... 340/551

* cited by examiner

*Primary Examiner*—Eric M Blount
(74) *Attorney, Agent, or Firm*—Egbert Law Offices PLLC

(57) ABSTRACT

An apparatus to prevent workers from inadvertently discarding metal articles is used in the hospitality industry. The apparatus includes a base suitable for mounting to an open end of a waste receptacle, a tray pivotally mounted to the base, and a metal detector mounted to the underside of the tray. The metal detector detects the presence of metal articles deposited in the tray amidst food scraps or other waste. The metal detector signals an audible alarm alerting workers to the presence of metal articles in the waste. Once the metal articles are removed, the worker can use a handle or a button system to pivot the tray, so as to deposit the food scraps or other waste in the waste receptacle.

15 Claims, 2 Drawing Sheets

FLATWARE DETECTION APPARATUS

CROSS-REFERENCE TO RELATED U.S. APPLICATIONS

The present application claims priority under 35 U.S.C. § 119(e) from U.S. Provisional Application Ser. No. 60/807,384, filed on Jul. 14, 2006, and entitled "FLATWARE SAVER".

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to the field of metal detection devices. More particularly, the present invention relates to metal detection devices used in the hospitality industry to prevent workers from inadvertently discarding flatware or other metal articles. More particularly, the present invention relates to a metal detection device mounted atop a waste receptacle to prevent workers from inadvertently discarding flatware or other metal articles.

2. Description of Related Art Including Information Disclosed Under 37 CFR 1.97 and 37 CFR 1.98.

One of the most difficult problems faced by the hospitality industry, including but not limited to restaurant operators, hotels, cruise lines, and any other business that uses metal flatware, is reducing or eliminating costs associated with inadvertently disposed of kitchen equipment. Metal flatware and other metal objects, such as small containers used for sauces or dressings, are often discarded with the food scraps when the staff brings the dishes to the dishwashing area for cleaning. Valuable pieces of equipment get lost in the trash continuously, leading to an increase in the operational costs for businesses. There is an ongoing need in the hospitality industry for a useful, reliable and convenient metal detector that can alert the staff to the presence of metal flatware or other kitchen equipment being placed in waste receptacles unintentionally. There is also a need to easily retrieve the discarded kitchen equipment, so as to avoid the cost of replacement.

Various patents have issued relating to such solutions. For example, U.S. Pat. No. 6,833,789, issued on Dec. 21, 2004 to Carmen et al., teaches a waste receptacle-mounted apparatus for scanning for metal objects. The apparatus includes a mounting lip adapted to conform to the top periphery of the waste receptacle and adapted to removably mount to and surround the aperture of the waste receptacle. A funnel-shaped entryway extends from the mounting lip. A plurality of vertical walls extend below the mounting lip and the top periphery of the waste receptacle and are attached to the funnel-shaped entryway so as to form an opening to the waste receptacle. A detector coil surrounds the vertical walls for detecting metal passing through the opening. Control electronics coupled to the detector coil include a speaker and a light indicator for warning that the detector coil has detected metal passing through the opening. A counter displays the number of times the detector coil has detected metal passing through the opening. A gain adjust is provided for adjusting the sensitivity of the detector coil.

U.S. Pat. No. 6,667,689, issued on Dec. 23, 2003 to Steffen et al., describes a device that easily fits on a waste receptacle and will sound an audible alarm when silverware that has been magnetized and likely hidden within other refuse falls through a sensing cavity on its way to the waste receptacle. This device will not trigger on any other metallic or non-metallic material due to its sensing of only passing magnetic fields. Silverware material conducive to magnetization can be easily magnetized and will retain such characteristics for a long period of time making it a practical way to differentiate silverware from other metallic refuse. The device also uses a sensing switch that activates the same audible alarm when an attempt is made to bypass the unit by removing it from the refuse container. A key switch provides security that enables alarm reset only by authorized personnel. A low battery indicator is provided by the pulsing of the audible alarm.

U.S. Pat. No. 6,222,450, issued on Apr. 24, 2001 to Clements, teaches a support assembly for a metal detection device. The detection device includes a housing with a central orifice, an induction member surrounding the orifice for generating an output voltage when a metal object is passed nearby, and a mechanism which includes pulse-emitting and pulse-receiving members for selectively sensing an object passing through the orifice. The support assembly includes a base member having front, rear and opposed side portions sized and shaped for positioning beneath the housing. The base member has a central aperture adapted for substantial alignment with the housing orifice when the base member is positioned beneath the housing. A mechanism secures the base member to the housing, and a plurality of mounting posts are disposed along the base member front, rear and side portions for positioning a metal detection device induction member about the central aperture. A mounting mechanism is provided for the pulse-emitting and pulse-receiving members on opposite sides of the central aperture. A plurality of pulse-regulating elements are provided for eliminating ambient light interference and cross-pulse sensing.

U.S. Pat. No. 5,797,497, issued on Aug. 25, 1998 to Edwards, describes a device for trapping flatware in food waste prior to entry into a waste receptacle which includes a housing positioned onto the waste receptacle having a downwardly sloping chute, an electronic metal detector disposed in the housing, and a mechanically-operated pivoting door that guards the lower opening of the chute. A spring-loaded mechanical linkage closes the door upon being released by an actuator that is signaled by the metal detector as to when flatware is present. The use of a spring-loaded mechanism to operate the pivoting door minimizes power requirements and is lightweight.

U.S. Pat. No. 4,742,339, issued on May 3, 1988 to Baziuk, teaches a flatware detector device for detecting metal objects discarded as trash along with non-metallic trash material. The detector device includes a metal detecting ring or the like mounted at the top of a waste receptacle, in combination with circuitry adapted to trigger an alarm upon passage of a metal object such flatware into the waste receptacle. A counter may also be provided to count the number of metal objects placed into the waste receptacle.

It is an object of the present invention to provide a metal detection apparatus which prevents flatware and other metal kitchen equipment from being inadvertently discarded.

It is another object of the present invention to provide a metal detection apparatus which lowers the operational costs of businesses in the hospitality industry.

It is another object of the present invention to provide a metal detection apparatus which fits easily on the top opening of a waste receptacle.

It is another object of the present invention to provide a metal detection apparatus which allows a worker to retrieve metal objects from food scraps before they fall into the opening of a waste receptacle.

It is a further object of the present invention to provide a metal detection apparatus that is easily portable.

It is another object of the present invention to provide a metal detection apparatus that requires low or no maintenance.

It is another object of the present invention to provide a metal detection apparatus that has a long battery life.

It is a further object of the present invention to provide a metal detection apparatus that allows the user to easily mark non-metallic articles with a metallic signature.

These and other objects and advantages of the present invention will become apparent from a reading of the attached specification and appended claims.

BRIEF SUMMARY OF THE INVENTION

The present invention is an apparatus for preventing inadvertent discarding of metal articles which comprises a base suitable for fitting over a waste receptacle, a tray pivotally coupled to the base, and a metal detector connected to the underside of the tray for detecting metal placed on the tray. The base of the apparatus has a lip extending downwardly from the base with a diameter suitable for mounting the base on the open end of a waste receptacle. The tray is rotatably attached to the base by a horizontal axle crossing a diameter of the base. The tray has a bottom surface and a side surrounding the surface which form a bowl shape. The apparatus has a handle connected to the tray which extends outwardly therefrom and which pivots the tray between a first position in a horizontal orientation and a second position opening to an interior of the waste receptacle. The handle has a spring locking mechanism for holding the tray in the first position. The apparatus also has a control electronics box mounted to the base which is cooperative with the metal detector. The control electronics box has comprises an audible alarm affixed to the base for activating when the metal detector detects at least one metal article present in the tray. Additionally, the control electronics box comprises a button affixed to the base and cooperative with the tray for moving the tray from the first position to the second position.

The present invention is a metal detection apparatus which fits over the top opening of a waste receptacle. The apparatus comprises a base, a tray pivotally coupled to the base, a metal detection means coupled to an underside of the tray, and a handle used to move the tray from a first horizontal position to a second position angularly displaced from the horizontal. A restaurant worker can deposit food scraps into the tray. The metal detection apparatus will signal an audible alarm if it detects one or more metal articles, such as flatware, present in the tray. The worker may then easily remove the metal articles from the tray prior to using the handle to deposit the food scraps into the opening of the waste receptacle. The audible alarm will continue to signal until all metal articles are removed from the tray.

The present invention may also include a system by which the tray may be automatically moved from the first position to the second position at the push of a button. This allows the worker to deposit the food scraps into the opening of the waste receptacle without the use of the handle.

DETAILED DESCRIPTION OF THE INVENTION

Figure 1:
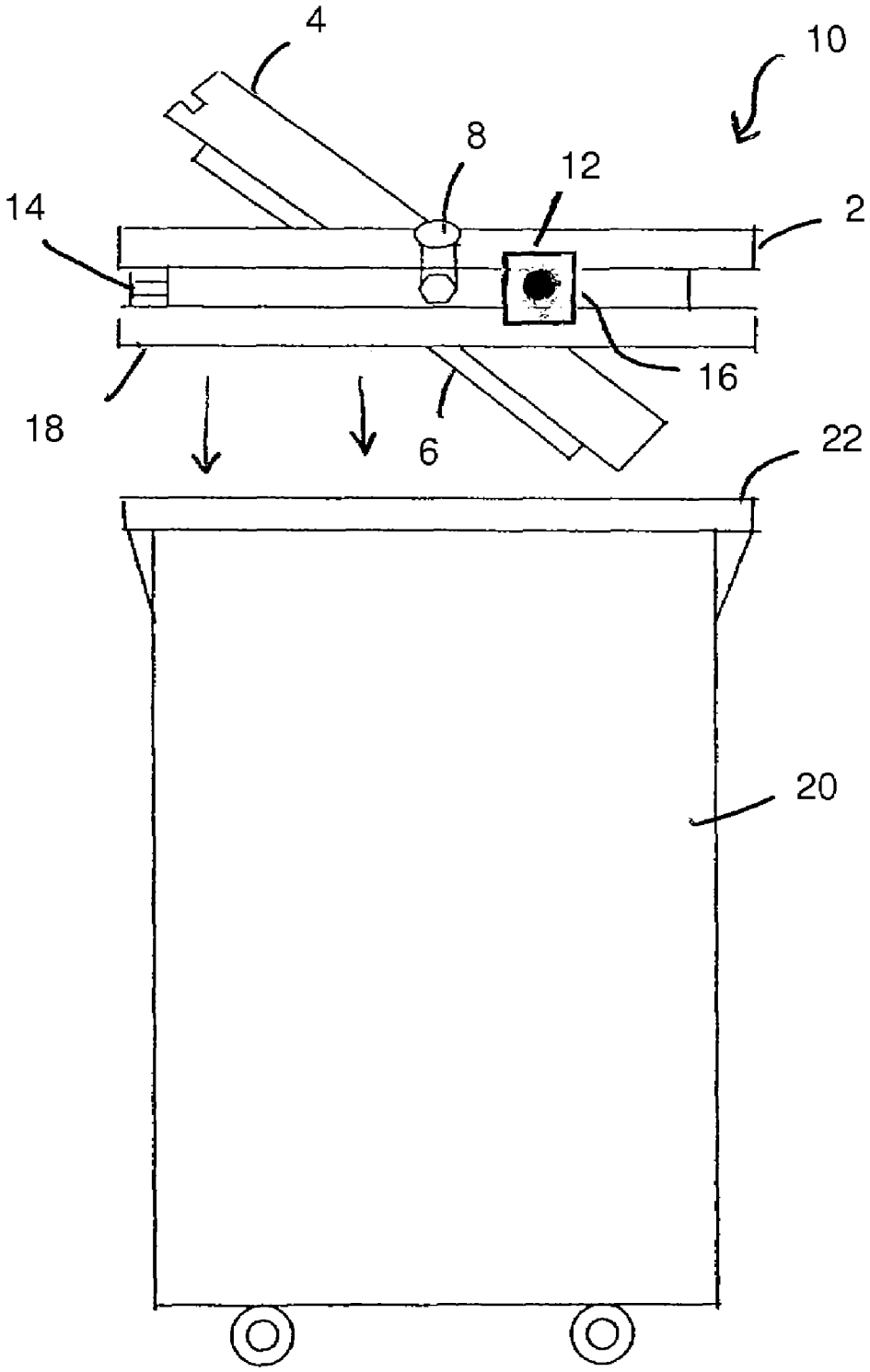
FIG. 1 is a side elevational view of the metal detection apparatus of the present invention above a waste receptacle.
Figure 2:
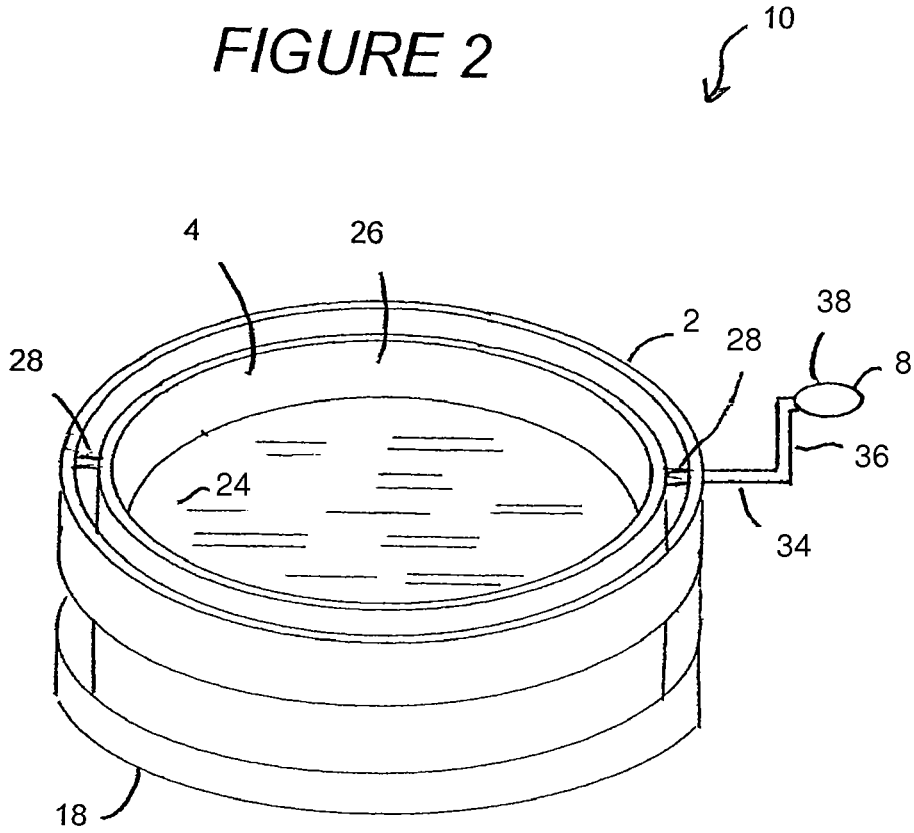
FIG. 2 is an upper perspective view of the metal detection apparatus of the present invention shown apart from the waste receptacle.
Figure 3:
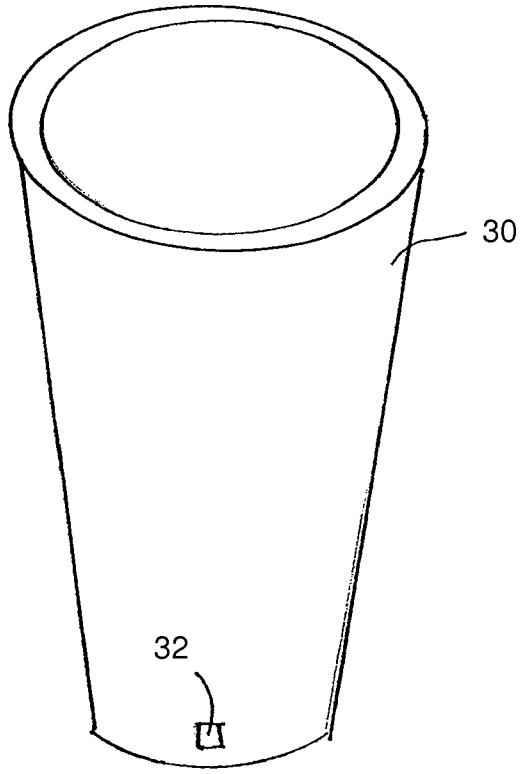
FIG. 3 is a perspective view of a drinking glass with a metallic signature applied thereon.

The preferred embodiment of the present invention and its advantages are best understood by referring to FIGS. 1-3 of the drawings, like numerals being used for like and corresponding parts of the various drawings.

FIG. 1 shows the metal detection apparatus 10 of the present invention. Essentially, the metal detection device 10 comprises base 2, tray 4, metal detector 6, and handle 8. Tray 4 is pivotally connected to base 2. FIG. 1 shows tray 4 in a second position angularly offset from horizontal. Handle 8 is connected to base 2 and tray 4, and serves to move tray 4 from a horizontal first position to a second position. The metal detector 6 is coupled to an underside of tray 4. Base 2 also includes a spring locking mechanism 14, which fixes tray 4 in the horizontal first position. The control electronics box 12 is shown coupled to base 2. Additionally, a button 16 is shown positioned on the control electronics box 12. Button 16 can be used to move tray 4 from the first position to the second position without the use of handle 8.

Base 2 has a lip 18 which positions metal detection apparatus 10 on a lip 22 of a waste receptacle 20. The metal detection apparatus 10 may be sized so as to fit a specific size waste receptacle 20. When the metal detection apparatus 10 is positioned on the waste receptacle 20 and the tray 4 is in a horizontal first position, the metal detection apparatus 10 blocks access to the interior of waste receptacle 20. The control electronics box 12 is connected to the metal detector 6 so as to emit an audible alarm when the detector 6 detects the presence of at least one metal article present in tray 4. The alarm alerts the worker, who may then remove the metal article(s) prior to dumping the food scraps into the waste receptacle 20. The audible alarm continues to signal the worker until all metal articles are removed from tray 4. Control electronics box 12 also controls the button system 16 for moving the tray 4. Ideally, each component of the metal detection apparatus 10 should be constructed of non-metallic materials such as plastic so as not to interfere with the operation of the metal detector 6. Any metallic components associated with control electronics box 12 should be arranged so that they are not detected by metal detector 6.

FIG. 2 also shows a perspective view of the metal detection apparatus 10. The tray 4 is pivotally mounted to the base 2 by a horizontal axle 28. The axle 28 can be a single axle which crosses the diameter of the base 2 beneath the tray 4. Alternatively, it can be a pair of axles mounted at opposite ends of the tray 4.

The base 2 is shown as being circular in shape. Alternatively, the base 2 can be square, oval, or rectangular-shaped, depending on the shape of the waste receptacle to be fitted with the apparatus 10. The base 2 has an interior volume in which the tray 4 fits. The tray 4 is shaped so as to fit within the interior volume of the base 2. As shown, tray 4 has a bottom 24 surrounded by side 26. Bottom portion 24 and side 26 form a bowl shape within the tray 4. The tray 4 is shallow enough to allow the user to easily retrieve metal articles deposited thereon.

The handle 8 has a first handle portion 34 extending longitudinally from the axle 28, a second handle portion 36 extending generally vertically from an end of the first handle portion 34, and a grip portion 38 affixed to the end of second portion 36. The first handle portion 34 and the second handle portion 36 form an "L" shape rotatable about the axis of the first handle portion 34. The grip portion 38 is constructed of a non-metallic material such as wood or rubber. After the user has retrieved any metal articles from the tray 4, he then pulls the handle 8, which pivots the tray and dumps the remaining food scraps into the waste receptacle. Rotating the handle back to a resting position returns the tray to the first horizontal position. The handle 8 has a spring locking mechanism cooperative with the tray 4 and the axle 28 which holds the tray 4 in the first horizontal position until the user rotates the handle.

Several of the devices in the prior art referenced above merely detect metal articles as they pass through the open end of a waste receptacle. While this can be useful, it still requires a user to reach down into the waste receptacle to retrieve the metal articles, which can be a messy and time consuming process.

FIG. 3 shows a drinking glass 30 with a metallic signature 32 affixed to a side of the glass 30. Alternatively, the metallic signature 32 may be placed on the bottom of the glass 30, or another suitable location. The use of the metallic signature 32 allows the user to prevent non-metallic articles from being inadvertently discarded, thereby increasing the usefulness of the present invention. The metallic signature 32 is a piece of metal sufficient in size to be detected by the metal detector 6 of the present invention. The metallic signature 32 may be affixed to the glass 30 by an adhesive. The metallic signature 32 may also be affixed to other non-metallic articles such as porcelain or ceramic dishes, or plastic containers used in the hospitality industry.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

The invention claimed is:

1. An apparatus for preventing discarding of metal articles, the apparatus comprising:

a base suitable for fitting over a waste receptacle;

a tray pivotally coupled to said base at diametrically opposite sides thereof, said tray being pivotable between a first position in a horizontal orientation and a second position angularly offset from the horizontal orientation so as to form a waste releasing opening;

a metal detection means coupled to an underside of said tray, said metal detection means for detecting a presence of metal on a top side of said tray; and a handle means connected to said tray and extending outwardly therefrom, said handle means connected to said tray for pivoting said tray between said first position and said second position, said handle means having a spring locking means thereon for fixing said tray in said first position.

2. The apparatus of claim 1, said base having a lip extending downwardly from said base, said lip having a diameter suitable for mounting said base on an open end of the waste receptacle.

3. The apparatus of claim 1, said tray having a bottom surface and a side surrounding said bottom surface so as to form a bowl shape.

4. The apparatus of claim 1, further comprising:

a control electronics box mounted to said base and cooperative with said metal detection means.

5. The apparatus of claim 4, said control electronics box comprising:

an audible alarm means affixed to said base for activating when said metal detection means detects at least one metal article present in said tray.

6. The apparatus of claim 4, said control electronics box comprising:

a button means affixed to said base and cooperative with said tray for moving said tray from said first position to said second position.

7. An apparatus for preventing inadvertent discarding of metallic objects or metallic-labeled objects, the apparatus comprising:

a waste receptacle;

a base mounted on said waste receptacle;

a tray pivotally mounted to said base, said tray being pivotable between a first position in a generally horizontal orientation and a second position angularly offset from the horizontal orientation so as to open toward said waste receptacle;

a metal detection means coupled to an underside of said tray, said metal detection means for detecting a presence of the metal or metallic-labeled objects on a top side of said tray; and a handle means connected to said tray and extending outwardly therefrom, said handle means for fixing said tray in said first position and for releasing said tray from said first position and for pivoting to said second position.

8. The apparatus of claim 7, said base having a lip extending downwardly from said base, said lip extending around an open end of said waste receptacle.

9. The apparatus of claim 7, said tray rotatably attached to said base by a horizontal axle crossing a diameter of said base, said tray having a bottom surface and a side surface surrounding said bottom surface so as to form a bowl shape.

10. The apparatus of claim 7, said handle means having a spring locking means connected thereto for fixing said tray in said first position.

11. The apparatus of claim 7, further comprising:

a control electronics box mounted to said base.

12. An apparatus for preventing inadvertent discarding of a metal article or a metallic-labeled object, said apparatus comprising:

a base having an annular interior, said base suitable for fitting over an open end of a waste receptacle;

a tray pivotally mounted to said base within the annular interior, said tray being pivotable between a first position extending horizontally across said base and a second position angularly offset from horizontal;

a metal detection means affixed to one of said base and said tray, said metal detection means for detecting the presence of the metal article on said tray when said tray is in said first position; and a handle means connected to said tray and extending outwardly therefrom, said handle means for pivoting said tray between a first position in horizontal orientation and a second position opening to an interior of the waste receptacle, said handle means having a spring locking means connected thereto for fixing said tray in said first position.

13. The apparatus of claim 12, further comprising:

a control electronics box mounted to said base.

14. The apparatus of claim 13, said control electronics box comprising:

an audible alarm means for activating when said metal detection means detects at least one metal article present in said tray when said tray is in said first position.

15. The apparatus of claim 13, said control electronics comprising:

a button means affixed to said base and cooperative with said tray for moving said tray from said first position to said second position.

* * * * *